US008381657B1

(12) United States Patent
Hooke

(10) Patent No.: US 8,381,657 B1
(45) Date of Patent: Feb. 26, 2013

(54) ENHANCED GRENADE

(75) Inventor: Ryan Hooke, Sparta, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 6 days.

(21) Appl. No.: 13/174,985

(22) Filed: Jul. 1, 2011

Related U.S. Application Data

(63) Continuation-in-part of application No. 12/582,946, filed on Oct. 21, 2009, now abandoned.

(60) Provisional application No. 61/108,092, filed on Oct. 24, 2008.

(51) Int. Cl.
*F41A 9/00* (2006.01)

(52) U.S. Cl. ..... 102/487; 102/481

(58) Field of Classification Search ..... 102/498, 102/367, 368, 370, 487, 496, 495, 491, 481
See application file for complete search history.

(56) References Cited

U.S. PATENT DOCUMENTS

| | | | | | |
|---|---|---|---|---|---|
| 3,992,997 | A * | 11/1976 | McCubbin et al. | ..... | 102/481 |
| 4,004,516 | A * | 1/1977 | Johnson et al. | ..... | 102/499 |
| 4,041,869 | A * | 8/1977 | San Miguel | ..... | 102/481 |
| 4,982,668 | A * | 1/1991 | Bender et al. | ..... | 102/495 |
| 5,035,180 | A * | 7/1991 | Purcell et al. | ..... | 102/481 |
| 5,035,181 | A * | 7/1991 | Jacks et al. | ..... | 102/481 |
| 5,170,007 | A * | 12/1992 | Figge, Sr. | ..... | 102/481 |
| 5,763,027 | A * | 6/1998 | Enders et al. | ..... | 428/34.7 |
| 7,354,271 | B2 * | 4/2008 | Brunn | ..... | 434/12 |
| 7,712,419 | B1 * | 5/2010 | Cheng et al. | ..... | 102/487 |
| 2010/0024675 | A1 * | 2/2010 | Cotet et al. | ..... | 102/481 |

* cited by examiner

*Primary Examiner* — Michael Carone
*Assistant Examiner* — Reginald Tillman, Jr.
(74) *Attorney, Agent, or Firm* — Michael C. Sachs

(57) ABSTRACT

An enhanced grenade exhibiting improved insensitive munitions (IM) characteristics while providing improved lethality or non-lethality as desired.

16 Claims, 5 Drawing Sheets

ENHANCED GRENADE

CROSS REFERENCE TO RELATED APPLICATION

This application is a continuation-in-part of application Ser. No. 12/582,946 which had been filed on Oct. 21, 2009, now abandoned which previous application in itself claims the benefit of U.S. Provisional Patent Application Ser. No. 61/108,092 filed Oct. 24, 2008 the complete file wrappers of all of which applications are hereby incorporated by reference as though fully set forth at length herein.

U.S. GOVERNMENT INTEREST

The inventions described herein may be manufactured, used and licensed by or for the U.S. Government for U.S. Government purposes.

FIELD OF THE DISCLOSURE

This disclosure relates generally to an enhanced hand grenade.

BACKGROUND OF THE DISCLOSURE

Fragmentation hand grenades have a casing typically made of cast iron or steel which—when the grenade is detonated—spread fragments in all directions. These fragmentation patterns from such grenades are somewhat unpredictable due—in part—to their construction, their orientation when detonated, and external obstacles or other irregularities such as terrain, etc. As can be readily appreciated they are generally unsuitable for non-lethal application.

SUMMARY OF THE DISCLOSURE

An advance is made in the art according to an aspect of the present disclosure directed to an enhanced grenade that provides a more predictable and reliable fragmentation pattern. Additionally, grenades constructed according to the present disclosure may advantageously be made suitable for non-lethal applications. Still further grenades constructed according to the present disclosure are particularly well-suited for use with insensitive-munitions (IM) energetic or environmentally-friendly energetic materials.

In one exemplary embodiment a number of shaped fragments are disposed in a volumetric area between an outer shell and an inner shell of the grenade, substantially fixed in place by a filler material. Advantageously, the fragments may be a variety of shapes, sizes, materials. A quantity of energetic material is disposed within the inner shell and detonated by a fuze. Upon detonation, the fragments scatter. Prior to detonation, the inner shell contains the energetic material and contributes to an insensitive munitions (IM) characteristic of the grenade.

In another exemplary embodiment, the fragments and shell(s) are constructed of materials—for example plastic, rubber, composites, etc) such that a substantially non-lethal device is produced. Variation(s) of this embodiment may employ paint or other marking materials such that the non-lethal device is useful for marking an area or target(s). Advantageously, variations of these non-lethal embodiments are particularly well-suited to training applications.

In still another exemplary embodiment, the outer shell and fragment(s) are a substantially unitary composite structure.

As a result, a robust, effective grenade exhibiting particularly desirable IM characteristics is produced.

BRIEF DESCRIPTION OF THE DRAWING

A more complete understanding of the present disclosure may be realized by reference to the accompanying drawings in which:

FIG. 2A is a more detailed cross-sectional view of a further alternate embodiment enhanced hand grenade according to the present disclosure, whereas

DETAILED DESCRIPTION

Figure 1:
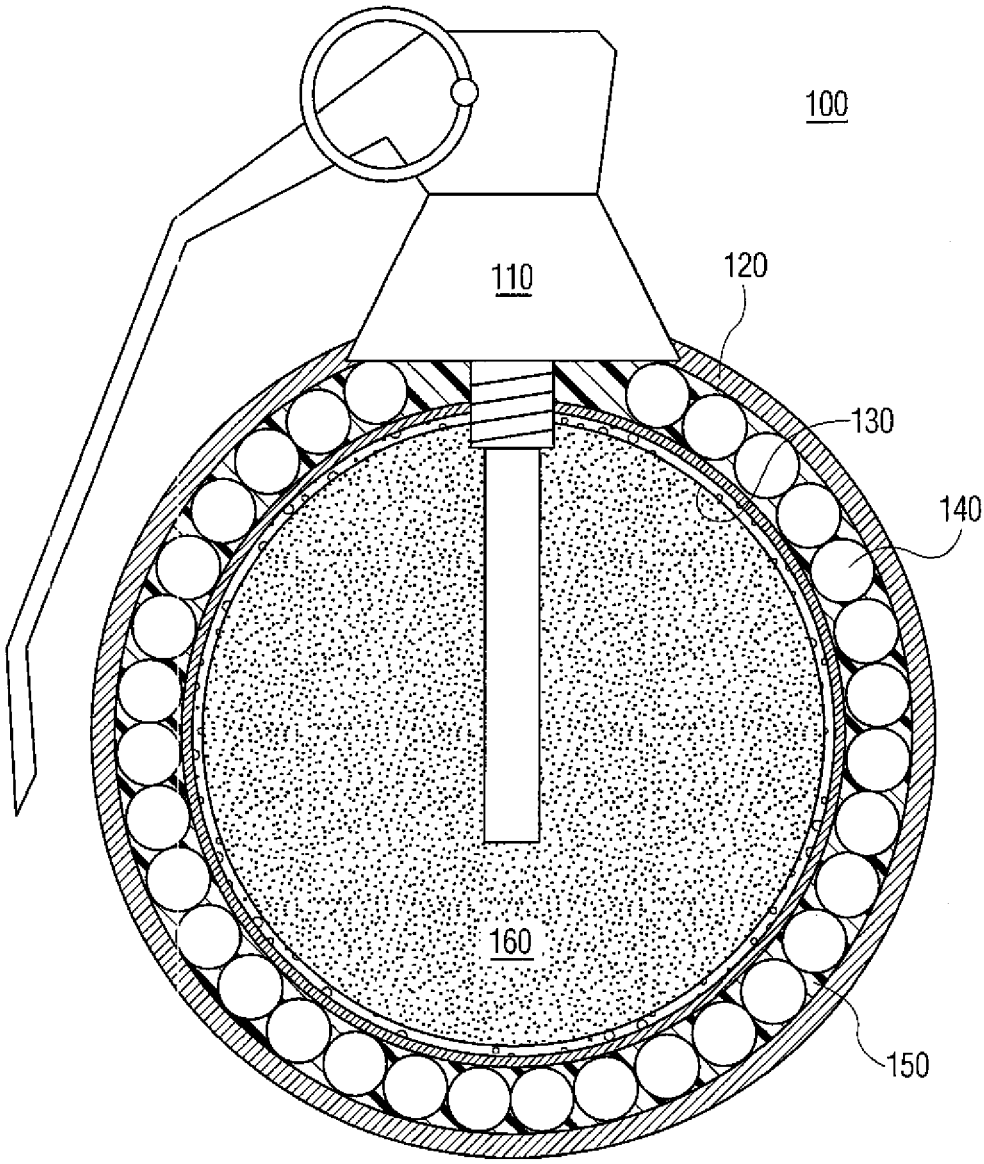
FIG. 1 is a cross-sectional view of an exemplary enhanced hand grenade according to an aspect of the present disclosure.

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

In the claims hereof any element expressed as a means for performing a specified function is intended to encompass any way of performing that function. The invention as defined by such claims resides in the fact that the functionalities provided by the various recited means are combined and brought together in the manner which the claims call for. Applicants thus regards any means which can provide those functionalities as equivalent as those shown herein. Finally, and unless otherwise explicitly specified herein, the drawings are not drawn to scale.

Generally, a modern hand grenade comprises a cast iron or steel body which holds an explosive charge and a fuze assembly. The fuze assembly further comprises a detonator which ignites the charge, a time delay train leading to the detonator, a primer, a striker, a striker spring, a safety lever and a safety pin. The striker is in a cocked position from the time of manufacture with the striker spring under tension. A catch at one end of the safety lever restrains the striker so long as the lever is held against the body of the grenade while the safety pin secures the position of the safety lever until the pin is pulled.

Operationally, the grenade may be held in a throwing hand with the safety lever held against the body of the grenade. The safety pin is then removed. As the safety lever releases—as a result of throwing the grenade for example—the striker is released which impacts the primer thereby initiating the time delay train. The time delay train begins burning at one end and the burning progresses toward the opposite end at a relatively low rate of travel. After a predetermined period of time, the burning reaches the detonator, the detonator fires and ignites the explosive charge causing the body of the grenade to explode, scattering fragmented shrapnel over a target area.

FIG. 1 is a cross-sectional view of an enhanced grenade 100 according to an aspect of the present disclosure. As shown in this FIG. 1, the enhanced grenade 100 comprises a fuze 110, an outer shell 120, an inner shell 130, a plurality of fragments (balls) 140 disposed between the outer shell 120 and the inner shell 130, a filler material 150 disposed in any voids in the region between the inner shell 130 and the outer shell 120 not specifically occupied by the balls 140, and finally a quantity of energetic material 160.

As can be appreciated, when operated the fuze ignites the energetic material which burns and generates a quantity of very high pressure gas which in turn forces the inner shell 130 outward toward the balls 140 and the outer shell 120 until the pressure becomes so great as to cause the structure to explode. As a result of this explosion, the balls (fragments) 140, along with fragments of the shells and other structures are scattered over the target area at high velocity.

At this point those skilled in the art will appreciate that the use of balls 140 as fragments provides a number of distinct advantages. First, their uniform shape and size offer a more predictable fragmentation pattern than prior art "pineapple" grenades. Additionally, since they (the balls) generally remain intact and distinct from one another, the number of active fragments is quite predictable. In sharp contrast, a conventional fragmentary grenade may fragment into only a small number of active fragments upon detonation.

While to this point fragments of uniform shape/size have been shown, it is understood that the shapes/sizes/material/packing/orientation of the fragments may be varied and/or adjusted at the time of manufacture to meet certain application requirements.

As can be readily appreciated, when constructed from metallic components a grenade according to the present invention may be particularly lethal. In particular, balls 140 constructed from bismuth, steel, iron or other suitably hard materials may produce a particularly lethal grenade when coupled with a steel shell and energetic material comprising high explosives such as TNT and/or HDX/RDX or variations thereof. Of course, the particular materials chosen for the shell, the balls and the energetic are variable depending upon the particular application for the grenade.

The filler material 150—which may comprise any of a variety of materials i.e., plastics, epoxies, urethanes, etc., holds the balls in their relative positions until the device is activated. As a result of this filler, balls 140 of a variety of sizes may be used within a single grenade. In this manner, no shifting or settling of the balls will occur prior to activation. Additionally, when the filler material exhibits an elastic characteristic, enhanced IM characteristics may result.

Figure 1A:
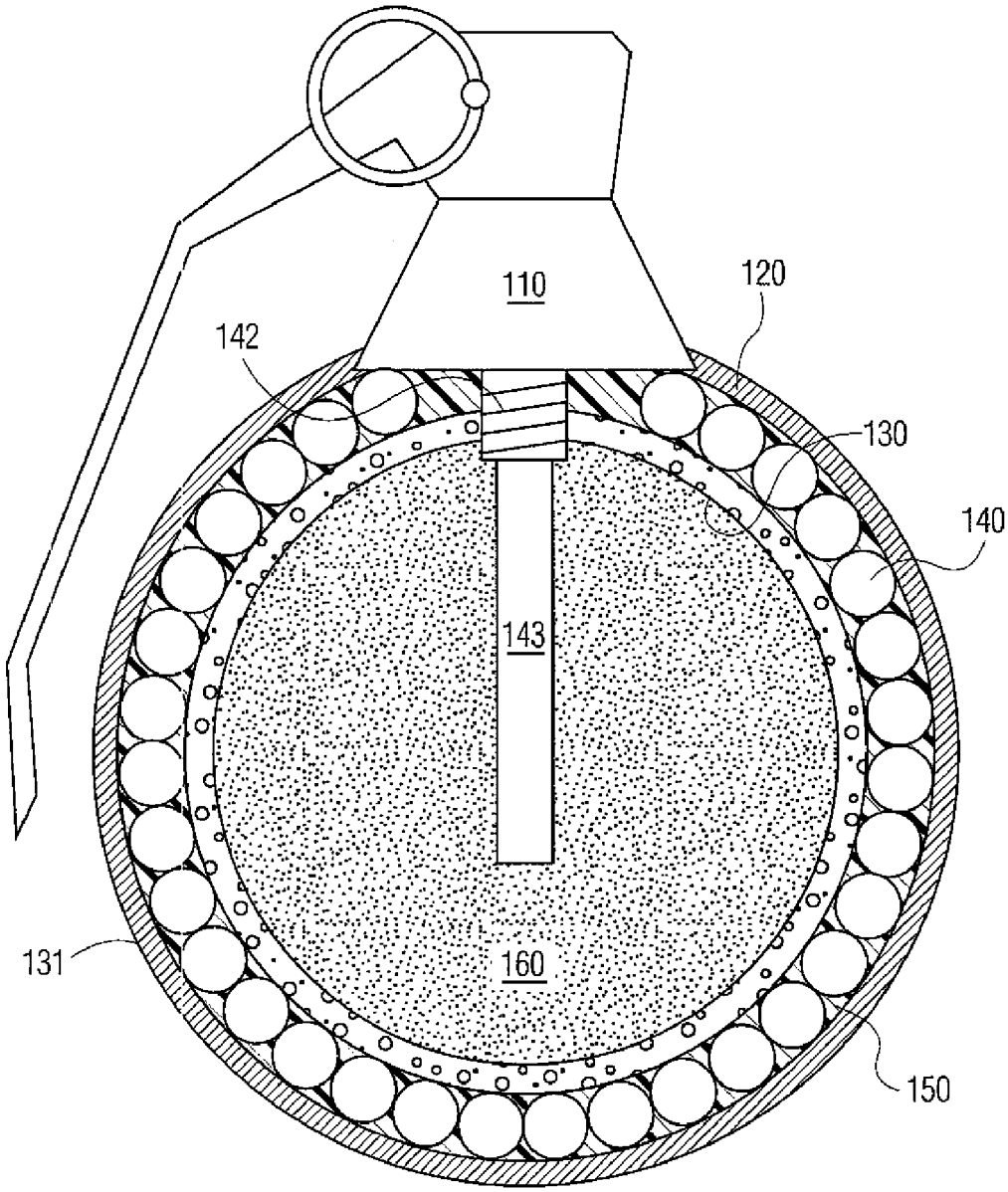
FIG. 1A is a more detailed cross-sectional view of a further exemplary enhanced hand grenade according to the present disclosure

Of particular interest is the inner shell 130 which separates the energetic material from the balls (shaped fragments) 140. Operationally, the inner shell 130 advantageously isolates the energetic material from the balls 140. In this manner, the energetic material is contained and isolated from external shock/temperature, etc, which could initiate an unintended detonation. In this inventive manner, the inner shell 130 advantageously isolates the energetic material resulting in a device exhibiting greater insensitivity to external shock and the benefits associated with insensitive munitions. In addition, the inner shell may be somewhat elastic, thereby absorbing initial shocks as well. Lastly, the inner shell may include micro-voids (or pressure absorbing objects) in its structure (see FIGS. 1A, 2A) which—when coupled with desirable materials—provide a "shock absorber" from external shock and during detonation thereby enhancing the IM characteristics and limiting any damage/deforming of the fragments during detonation. Accordingly, the inner shell may be constructed from a variety of plastic and/or metallic materials including plastic, rubber, aluminum, etc. FIG. 1A in a more detailed cross-sectional view of a further exemplary enhanced hand grenade according to the present disclosure shows exemplary such micro-voids 131 in inner shell 130, while FIG. 2A shows exemplary such micro-voids 231 in inner shell 230.

Notably, if the grenade is exposed to high temperature—for example in a fire—the inner shell may serve to contain the energetic material even beyond that temperature at which the energetic melts. Accordingly, the inner shell contributes to the IM characteristic from shock and temperature extremes as well. And additionally, presence of micro-voids in the inner shell walls can also serve to better contain pressure within the shell because the shell walls also could then compress somewhat more under the pressure.

Figure 2A:
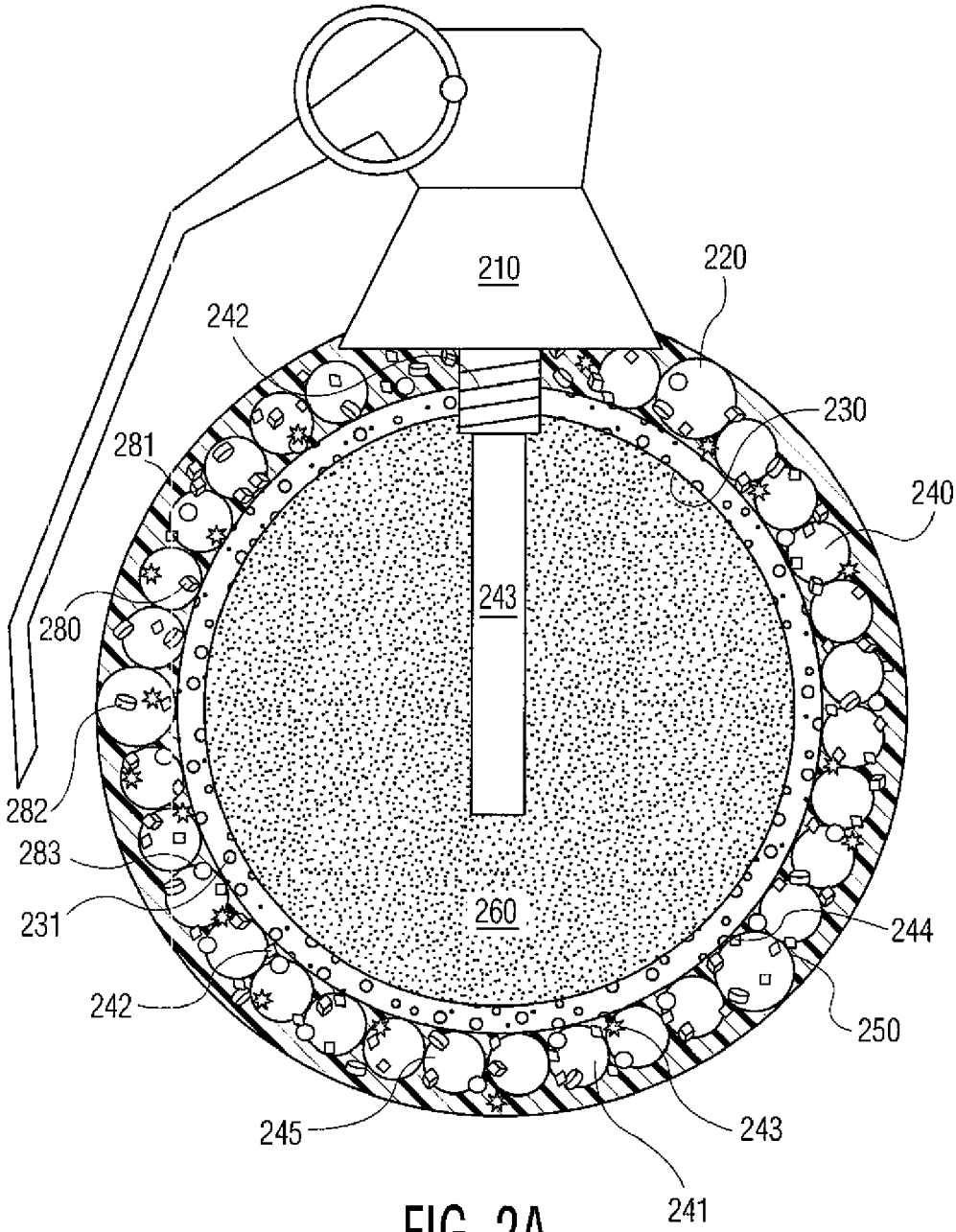
Figure 3:
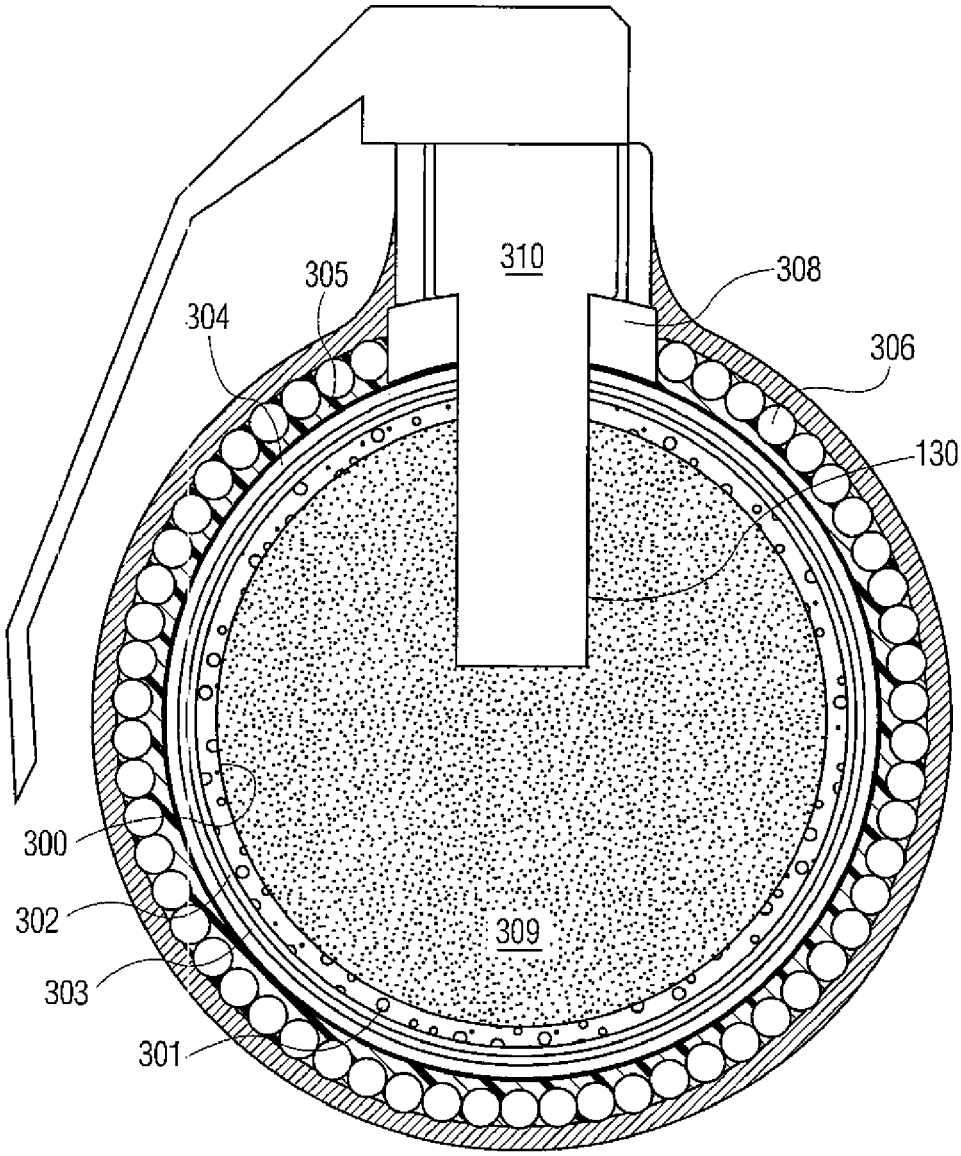
FIG. 3 is an example of an enhanced version of the grenade as described further within.

Of additional significance the shells may be constructed to melt when exposed to high temperatures thereby releasing/ejecting the fuze assembly (see FIGS. 1A, 2A) such that the energetic materials are not detonated explosively. In another embodiment, FIG. 1A fuze assembly 110 is shown having an exemplary shaft 142 joined into inner shell 130; shaft 142 may be of plastic. The shaft 142 may be threaded (as illustrated) and the inner shell then made to have mating internal threads. The shaft material and shell material have a different heat expansion rate. In the event of unexpected heat, fire, explosion, the shaft would tend to separate from the shell to release pressure. The energetic materials within the shell are such that they will not ignite (or properly ignite) unless there is gaseous pressure in the inner shell area, so the energetic material will therefore not ignite. The hole diameter in the inner shell that is around the shaft might expand faster than the shaft diameter would, and such would tend to release the fuze within the inner shell 130. This enhances IM qualities of the grenade, since the energetic materials within won't ignite without necessary pressure, and also can prevent fratricide of adjacent grenades. In another possible embodiment, there is a fuze gasket between shaft 142 and inner shell 130, e.g., which gasket is made of a high thermal expansion coefficient material such as UHMV, PVS, Polycarbonate. An ignition tube 143 extending through the shaft 142 may also be included, here shown extending into energetic material 160 to aid in ignition thereof. (FIG. 2A shows analogous structure with a shaft 242 of fuze assembly 210 joined to inner shell 230, and having extending ignition tube 243 to aid in igniting energetic material 260). In a yet other embodiment, the spherical shaped inner shell (with micro-voids or pressure absorbing objects) is next immediately enclosed by a spherical shaped pusher plate component of defined thickness and density to optimize fragment velocity and reliably achieve repeatable results. The outer surface of the pusher plate (or alternatively the inner surface of the outer shell component) can be coated with an ablative and blast absorber coating such as E-340AF, F-100E, or S886. The inner shell can also be made to have ablative properties which absorb heat/endothermic reaction, and the inner shell can also be made to have multiple densities, layered to absorb shock response. Next surrounding the pusher plate can be a spherically shaped void area to retard heat transfer to the next element which would then be the outer shell. The depth of this void area is comparable to the thickness of the inner shell or of a pusher plate. The purpose of the pusher plate is to magnify the blast coming from within the inner shell to increase explosive efficiency whereas the purpose of the ablative coating is to absorb heat, requiring more heat to melt through than if the ablative coating were not present. The void retards heat transfer also; it is like the void in double paned glass, e.g. The energetic material may also include aluminized filler for increased blast effects. The outer shell can also include filler material which is reactive if needed to initiate RM pellets or inert to buffer and prevent the RM from initiating and increasing the RM pellets range. With all these methods, the blast required to build up to burst out this grenade is increasingly magnified over the conventional grenade. While a grenade is usually anti-personnel this grenade could be powerful enough to be used on hard targets as well. Or alternatively, by adjusting or eliminating from the above mentioned features judiciously, one could make the grenade less lethal (rather than more potent), even less lethal than a conventional anti-personnel grenade. Thus this new grenade configuration provides the designer with great flexibility as to lethality. As mentioned before, the outer shell contains fragments embedded in plastic, which fragments scatter when the outer shell ruptures. Also contained in the outer shell and also around the fragments may be nano particles, included for enhanced blast effect. The outer shell may be covered by a low melting temperature plastic that melts away in a fire, e.g., which may release the fragments. During manufacture, the fragments for the outer shell may be held in place e.g. all equally spaced by a magnetic field, or else held by magnetic fields spatially in desired areas, until they can all be molded, casted, or overmolded in place. The fragments ideally should be close packed as much as possible to prevent blow by (when the grenade bursts) which would lead to lower fragment velocity. Alternatively, fragments may even be made of organic material including wood; the density of the wood can further be varied by mineralizing, water-logging the wood with heavy mineral solutions, or with heavy water. In the FIG. 3 example of this enhanced grenade, there is shown an enhanced grenade with inner shell 300 having micro-voids 301; a pusher plate 302 surrounding the inner shell; an ablative coating 303 on the outer surface of the pusher plate; a void area 304 between pusher plate 302 and outer shell 305. Outer shell here has fragments 306. The handle-fuze mechanism 310 has a plastic shaft 307 leading down into the energetic material 309, whereas the shaft 307 is surrounded by a plastic gasket 308 which is in outer shell 305.

At this point it is notable that while the discussion so far has involved using ball-shaped fragments, those skilled in the art will of course recognize that the invention is not so limited. In particular, the fragments may be ball-shaped (as already discussed) or not. More particularly, they may be balls, cubes, or nearly any shape including star shaped, etc as dictated by the particular application. As with the ball-shaped fragments however, these non-ball shaped fragments may be a uniform size or non-uniform size as the application dictates. Finally, the fragments may be a mix of shapes/sizes as well. In this manner and as used in this disclosure, a fragment is simply an object of any shape that is scattered upon detonation.

It is also noted that while the overall shape of the enhanced grenade has been substantially spherical, it is noted that the invention is not so limited. In particular, the grenade shape and its outer shell may be cylindrical, pyramidal, cubic etc or variations thereof. It is noted further that the inner and outer shells need not be the same shape. By way of example, a substantially spherical inner shell may be within a cubic outer shell. A variety of combinations of inner/outer shell shape combinations are contemplated. The only requirement is that the inner shell fit inside the outer shell for these configurations.

It is also noted that the materials from which the fragments (balls, etc) are constructed may be varied. In particular, bismuth, steel, aluminum, copper and alloys/variations are contemplated. In addition, ceramic materials are contemplated for fragment construction as well. Finally, explosive and/or reactive fragments are contemplated as being used according to the present disclosure as well. In this inventive manner, the grenade explodes scattering the reactive and/or explosive fragments which may enhance the effectiveness against the particular target. Reactive fragments may take a variety of forms. As shown in FIG. 2A, a reactive fragment might be a one piece metal fragment 280 joined to an explosive material piece 281; or the explosive fragment may be for instance spherical like as in 283 where a metal piece is at the center and is surrounded by an explosive material. Or, the explosive fragment may be all explosive material such as thermite in 283, and might be disc shaped; further, a select number of such explosive fragments may be designed to be clumped together. As described above, fragments may be mixed and varied in size, shape, materials, reactive, etc within a single grenade. Finally, fragments may be selectively positioned within the grenade to effect a particular fragmentation pattern or enhance its effectiveness against a particular target or targets.

Finally, it is contemplated that grenades according to the present disclosure may be used for training purposes. In this manner, the grenade will contain an energetic material (or not) that does not produce the scattering of fragments. For example, energetic that simply produce a flash or a bang or smoke but insufficient energy to generate an explosion and/or fragmentation of an outer shell are within the scope of the present disclosure. Accordingly, they may be used for training purposes without the danger of an unintended injury.

As can now be appreciated, if the outer shell 120 and the balls 140 as well as the inner shell 130 are selectively constructed from non-lethal components—for example plastics or rubber, etc then a substantially non-lethal device may be constructed. Such a device may employ alternative combinations of energetic material as required to emphasize the non-lethal aspect of this variation. In addition to these particular non-lethal materials, it is contemplated that paint—or other marking—fragments may be employed in both live-fire battlefield and training environments. In a battlefield environment, the grenade may be used to "mark" a target or area while in a training situation it may be used to indicate a hit on a target.

Figure 2:
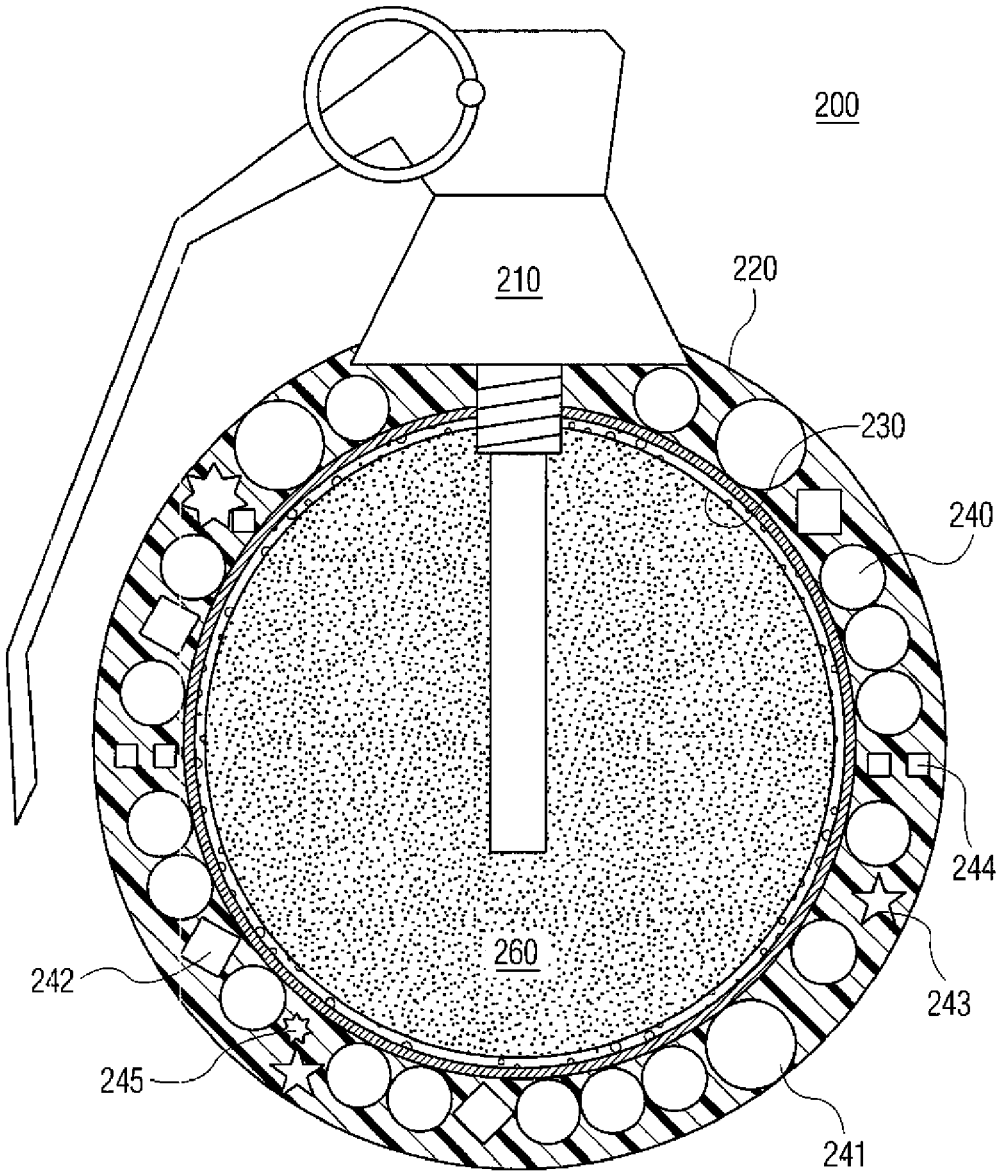
FIG. 2 is a cross-sectional view of an alternate embodiment enhanced hand grenade according to an aspect of the present disclosure.

FIG. 2 is a cross-sectional view of an alternative embodiment of an enhanced grenade according to an aspect of the present disclosure. As shown in this FIG. 2, the structure—while similar to that shown in FIG. 1—employs a substantially one (1) piece shell 220 including fragments 240-245 disposed therein. This shell preferably comprises a lightweight composite (i.e., carbon fiber/epoxy, fiberglass, polyester, ceramic, rubber, etc) which is formed with the fragments within the shell itself. An optional inner shell 230 may be employed to enhance the IM characteristics of the device as described previously. Additionally, a quantity of energetic material, i.e., high explosive, is used to explode the device and scatter the fragments 240. A possible advantage of the unitary shell design 220 is that in the event of a fire against the outer surface; the fragments may burn away or detach/drop off, then making the grenade somewhat less lethal in an explosion to the unintended user or person.

Again, it is noted that the particular materials, shapes, and compositions are variable. Accordingly, the overall shape of the grenade 200 need not be substantially spherical as shown in this exemplary FIG. 2. Also, the fragments may be any shape as desired and a grenade according to an aspect of the present disclosure may include a variety of fragments exhibiting different shapes/sizes/materials—all disposed within the unitary outer shell 220. In particular, the fragments may be different shapes/sizes 241, 242, 243 in multiple layers 244 within the shell 220.

At this point, while we have discussed and described the invention using some specific examples, those skilled in the art will recognize that our teachings are not so limited. More particularly the overall shape of the grenade may be any of a variety as desired, i.e sphere, cube, pyramid or variations/perturbations thereof. The shaped fragments may be any shape including cubes, hex-shaped, stars, etc, and constructed from any of a variety of materials including metals, plastic, marking, ceramic and/or reactive. The outer shell and/or inner shell may be constructed from materials that melt upon extreme temperature, thereby permitting the gradual release of energetic material without exploding. The shell(s) may be unitary, composite structures wherein the fragments are secured within the body of the composite shell. The fuze may be mechanical/chemical/electronic or combinations thereof as necessary. Finally, the fragments may be positioned within or around the structure thereby changing terminal effects of the device and enhancing its effectiveness against persons/property/materials. Finally, grenades constructed according to the disclosure may be placed such that they are activated via trip-wire or the like, or thrown by hand, or launched via gun-mounted or other launcher including rocket. Accordingly the invention should be only limited by the scope of the claims attached hereto.

The invention claimed is:

1. An enhanced tactical grenade comprising:

a hollow outer shell, substantially spherical in shape;

a hollow inner shell disposed within the outer shell, said inner shell of plastic and comprising micro void spaces therein which resist deformation of the inner shell during detonation;

a plurality of shaped fragments disposed in an area between the outer shell and the inner shell;

a filler disposed substantially in the area between the outer shell and the inner shell not occupied by the shaped fragments;

a quantity of energetic material disposed within the inner shell; and a fuze for detonating the energetic material such that upon detonation the grenade explodes and the shaped fragments are scattered, said fuze becoming dislodged from said outer shell if said grenade is exposed to a fire, by melting of the outer shell material, such fuze dislodging thereby preventing detonation of said energetic material through lack of interior grenade air pressure.

2. The enhanced grenade of claim 1 wherein the fuze comprises a plastic shaft leading down into the energetic material, whereas the shaft is surrounded by a plastic gasket which contacts the outer shell, wherein said plastic gasket melts if said grenade is exposed to a fire which allows said fuze to become dislodged thereby preventing detonation of said energetic material through lack of interior grenade air pressure.

3. The enhanced grenade of claim 2 wherein said shaped fragments are not all of the same size or shape or material composition.

4. The enhanced grenade of claim 3 wherein said shaped fragments are made from material selected from the group consisting of: metals, plastics, and rubbers.

5. The enhanced grenade of claim 3, wherein said shaped fragments include explosive or reactive fragments.

6. The enhanced grenade of claim 3 wherein said shaped fragments include paint or other marking material.

7. An enhanced tactical grenade comprising:

a composite outer shell, substantially spherical in shape, containing a plurality of shaped fragments, said outer shell having an inner wall defining a volume;

a plastic inner shell disposed along the inner wall of the composite shell thereby defining an inner volume, said inner shell comprising micro voids therein which resist deformation of the inner shell during detonation;

a quantity of energetic material disposed within the inner volume; and a fuze for detonating the energetic material such that upon detonation the grenade explodes and the shaped fragments are scattered, but said fuze becoming dislodged from said outer shell if said grenade is exposed to a fire, by melting of the outer shell material, such fuze dislodging thereby preventing detonation of said energetic material through lack of interior grenade air pressure.

8. The enhanced grenade of claim 7 wherein said outer shell is of a material comprising at least one of fiberglass, polyester, ceramic, fiber/epoxy, or rubber.

9. The enhanced grenade of claim 8, wherein said inner shell is surrounded by a pusher plate surrounding the inner shell.

10. The enhanced grenade of claim 9 having an ablative coating on the outer surface of the pusher plate.

11. The enhanced grenade of claim 10 having a void area between the pusher plate and the outer shell.

12. The enhanced grenade of claim 7 wherein the fuze comprises a plastic shaft leading down into the energetic material, whereas the shaft is surrounded by a plastic gasket which contacts the outer shell, wherein said plastic gasket melts if said grenade is exposed to a fire which allows said fuze to become dislodged thereby preventing detonation of said energetic material through lack of interior grenade air pressure.

13. The enhanced grenade of claim 7 wherein said shaped fragments are not all of the same size or shape or material composition.

14. The enhanced grenade of claim 8 wherein said shaped fragments are made from material selected from the group consisting of: metals, plastics, and rubbers.

15. The enhanced grenade of claim 8, wherein said shaped fragments include explosive or reactive fragments.

16. The enhanced grenade of claim 8 wherein said shaped fragments include paint or other marking material.

* * * * *